US008063291B2

(12) United States Patent
Crowder et al.

(10) Patent No.: US 8,063,291 B2
(45) Date of Patent: Nov. 22, 2011

(54) MUSICAL INSTRUMENT CASE WITH STAND AND INSTRUMENT HANGER

(76) Inventors: Miguel Crowder, Washougal, WA (US); Jose L Crowder, Washougal, WA (US)

( * ) Notice: Subject to any disclaimer, the term of this patent is extended or adjusted under 35 U.S.C. 154(b) by 0 days.

(21) Appl. No.: 12/572,597

(22) Filed: Oct. 2, 2009

(65) Prior Publication Data

US 2010/0059397 A1 Mar. 11, 2010

Related U.S. Application Data

(63) Continuation-in-part of application No. 12/555,490, filed on Sep. 8, 2009, now abandoned.

(51) Int. Cl.
*G10D 3/00* (2006.01)

(52) U.S. Cl. ..... 84/327; 206/314; 206/757

(58) Field of Classification Search ..... 84/327; 206/314, 757

See application file for complete search history.

(56) References Cited

U.S. PATENT DOCUMENTS

| | | | | | |
|---|---|---|---|---|---|
| 973,500 | A * | 10/1910 | Gunther | 206/14 |
| 4,147,254 | A * | 4/1979 | Bruce | 206/314 |
| 4,223,785 | A * | 9/1980 | Jacques | 206/314 |
| 4,474,290 | A * | 10/1984 | DeMato | 206/314 |
| 5,197,701 | A * | 3/1993 | Olson | 248/166 |
| 5,590,771 | A * | 1/1997 | Cota | 206/314 |
| 5,833,051 | A * | 11/1998 | Tiefenbrun et al. | 206/14 |
| 6,130,375 | A * | 10/2000 | Kellogg et al. | 84/327 |
| 6,422,522 | B1 * | 7/2002 | Woollen | 248/166 |
| 6,462,260 | B2 * | 10/2002 | Fediakov | 84/327 |
| D478,738 | S * | 8/2003 | Workman | D6/418 |
| 6,603,067 | B1 * | 8/2003 | Woollen | 84/327 |
| 6,951,280 | B1 * | 10/2005 | Lee | 206/314 |
| 6,959,810 | B2 * | 11/2005 | Neilson | 206/314 |
| 7,659,468 | B1 * | 2/2010 | Gottlieb | 84/327 |
| 2004/0007117 | A1 * | 1/2004 | Howard, Sr. | 84/327 |
| 2007/0158509 | A1 * | 7/2007 | Hubbell | 248/171 |
| 2009/0213598 | A1 * | 8/2009 | Terry | 362/419 |
| 2010/0059397 | A1 * | 3/2010 | Crowder et al. | 206/314 |
| 2010/0059409 | A1 * | 3/2010 | Crowder et al. | 206/757 |
| 2010/0270187 | A1 * | 10/2010 | Sonoda et al. | 206/314 |
| 2011/0203952 | A1 * | 8/2011 | Loban | 206/314 |

* cited by examiner

*Primary Examiner* — Lincoln Donovan
*Assistant Examiner* — Robert W Horn
(74) *Attorney, Agent, or Firm* — Kolisch Hartwell, PC

(57) ABSTRACT

The disclosure of the present invention contemplates that provision is made for the guitar case to be supported from its bottom end by a foldable stand so that the case can be inclined upwardly at an angle relative to the horizontal, such as a floor surface. A guitar, when removed from the guitar case can then be suspended or hung from a hanger provided on the guitar case. The guitar is thereby oriented to be suspended substantially vertically, relative to the ground, and the bottom of the guitar is spaced from the ground or floor surface.

6 Claims, 3 Drawing Sheets

MUSICAL INSTRUMENT CASE WITH STAND AND INSTRUMENT HANGER

CROSS-REFERENCE TO RELATED APPLICATION

This application is a continuation of U.S. patent application Ser. No. 12/555,490, filed Sep. 8, 2009, which application claims priority under 35 U.S.C. §119(e) to U.S. Provisional Patent Application Ser. No. 61/191,253, filed Sep. 8, 2008, the disclosures of which are incorporated herein by reference.

BACKGROUND OF THE INVENTION

The present disclosure relates to a musical instrument case and more particularly to one for a guitar, such as an acoustical, electrical, or standard guitar. The musical instrument case permits an instrument, to be removed therefrom and suspended from the case, which is inclined at an angle relative to the ground or a floor surface.

Guitar cases are well-known for use in holding and protecting a guitar, and include a bottom portion and an upper portion, or lid, which may be releasably secured to the bottom portion to maintain a guitar therewithin. The disclosure of the present invention contemplates that provision is made for the guitar case to be supported from its bottom end by a foldable stand so that the case can be inclined upwardly at an angle relative to the horizontal, such as a floor surface. A guitar, when removed from the guitar case can then be suspended or hung from a hanger provided on the guitar case. The guitar is thereby oriented to be suspended substantially vertically, relative to the ground, and the bottom of the guitar is spaced from the ground or floor surface.

DETAILED DESCRIPTION OF THE PREFERRED EMBODIMENT

Figure 1:
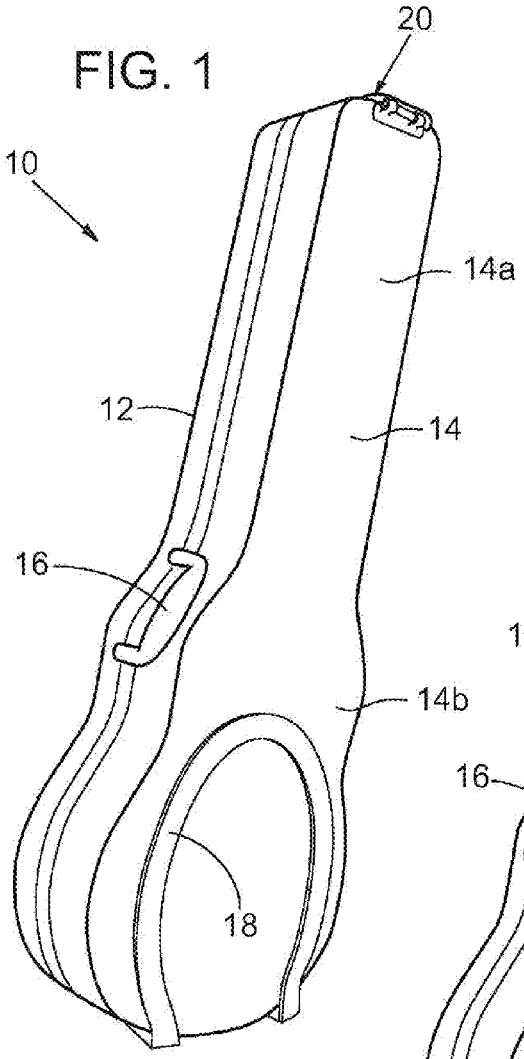
FIG. 1 is a perspective view of a musical instrument case in an upright position, showing a stand and a hanger, in accordance with the present invention, in their fully retracted positions.

As stated at the outset, the disclosure of the present invention comprises a musical instrument case, such as a guitar case, which includes a stand for supporting the guitar case in an inclined, upright position and a hanger for suspending a guitar from the top of the guitar case. As shown in FIG. 1, a guitar case is generally indicated at 10, and includes an upper portion or lid, indicated at 12 and a lower portion indicated at 14. Lid 12 is provided with a handle 16 and suitable latches (not shown) so that the lid may be selectively opened and closed relative to body portion 14. Body portion 14 includes a narrower, upward section 14*a* and an enlarged, widened lower section 14*b*. Thus far, all that has been described is entirely conventional.

Figure 2:
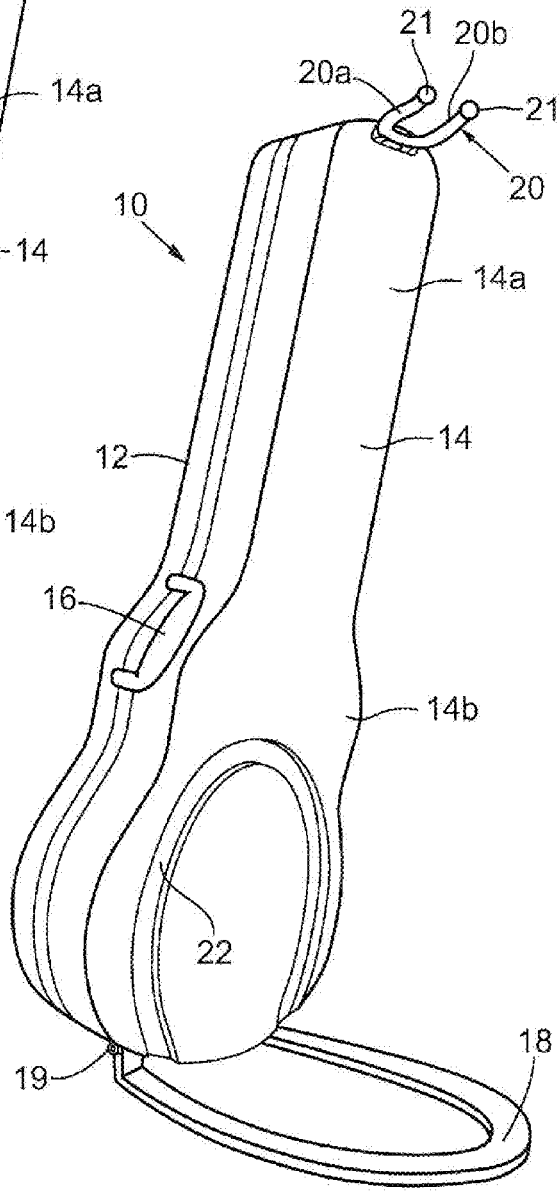
FIG. 2 is a view, oriented similarly to that shown in FIG. 1, of the guitar case positioned with its stand and hanger so that the hanger receives and suspends a guitar for positioning above the ground.

With respect to providing a system for enabling the guitar case to be positioned above a floor surface, in accordance with the present invention, there is provided a pivotally mounted stand, generally indicated at 18, shown in its retracted position in FIG. 1, and a hanger, generally indicated at 20, also shown in its retracted position. With reference now directed to FIG. 2, it will be seen that stand 18 and hanger 20 have been pivotally moved to their fully deployed positions. With stand 18 so deployed, as shown in FIG. 2, the guitar case may be oriented in an upright position, inclined relative to the ground. Hanger 20, which includes arms 20*a* and 20*b* is positioned to receive the neck of a guitar so that the guitar may be suspended therefrom. Hanger 20 also includes knobs 21 that prevent the neck from becoming inadvertently disengaged. The hanger arms may be suitably covered with a sleeve or other cover of elastomeric material.

As can be seen in FIG. 2, stand 18 includes an elongated member formed generally as an elongate curved element which is dimensioned for reception, in the retracted position in FIG. 1, in a corresponding groove or recess 22, when stand 18 is in its folded or retracted position. As will be seen in FIG. 2, a pivot connection indicated at 19 enables stand 18 to be selectively retracted in its folded position or extended to its deployed position. Groove 22 is dimensioned so that when stand 18 is in its fully retracted position, it is received so that the outer surface of bottom portion 14 remains substantially flush, so that the case can be positioned flat on the ground or other surface if desired.

Figure 3:
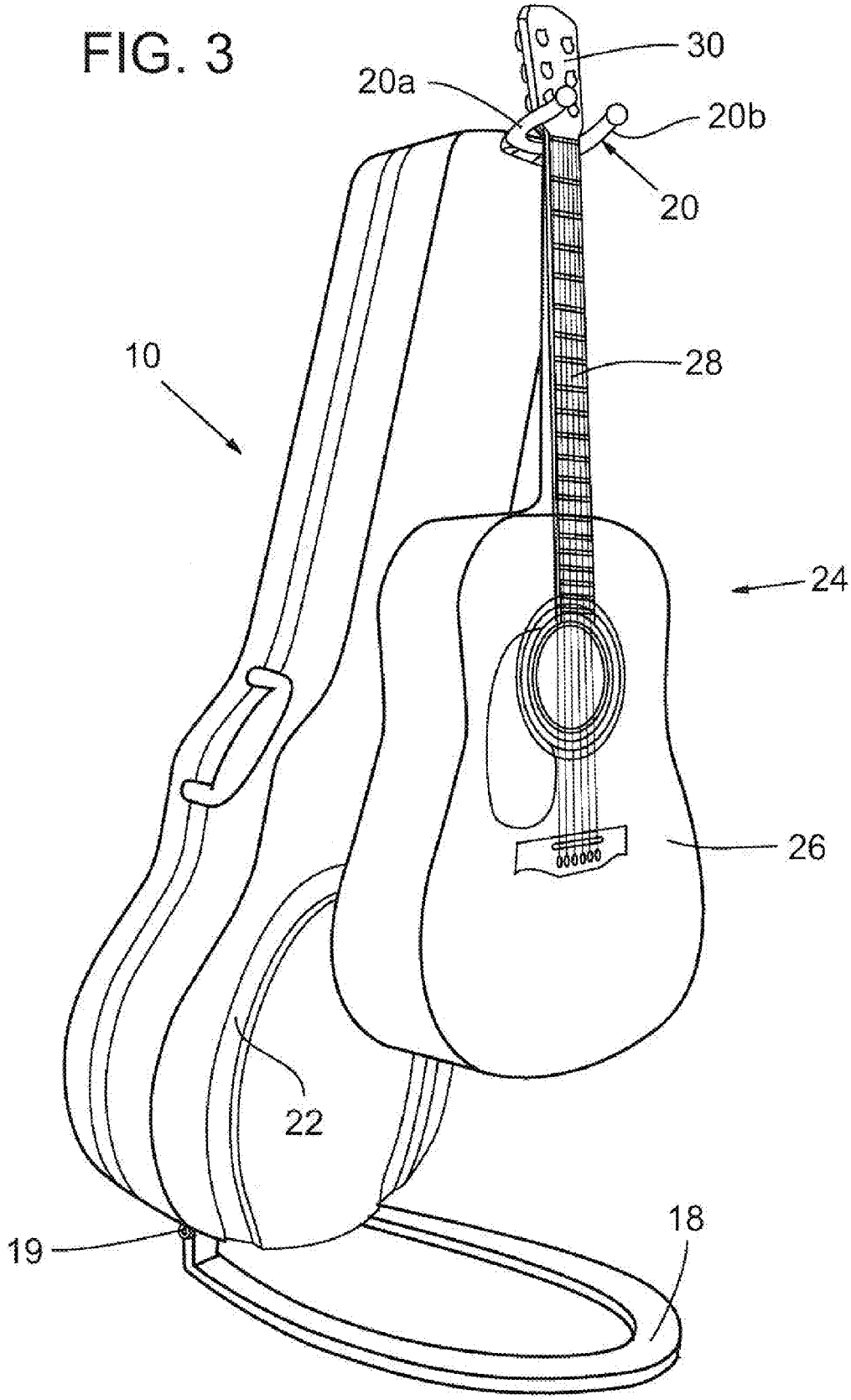
FIG. 3 is a view, oriented similarly to that shown in FIG. 2, showing a guitar suspended from the hanger.

FIG. 3 shows a guitar 24, which has been removed from the guitar case, and is suspended when stand 18 and hanger 20 are in their fully deployed position. Guitar 24 includes a main body portion 26, a neck 28 and a headstock 30. To suspend a guitar within hanger 20, an upper portion of neck 28 is initially positioned between arms 20*a* and 20*b* of hanger and then the guitar is allowed to be positioned or slip downwardly until headstock 30 engages those arms 20*a* and 20*b* so that the guitar is maintained in a substantially vertical, hanging position as shown in FIG. 3. The guitar, in this position, is readily presented to a musician. Some guitars do not include headstocks, and the present invention contemplates that hanger arms 20*a* and 20*b* may be selectively adjustable inwardly and provided with a suitable clamp to engage and hold the neck portion of a guitar so that it may be suspended.

Figure 4:
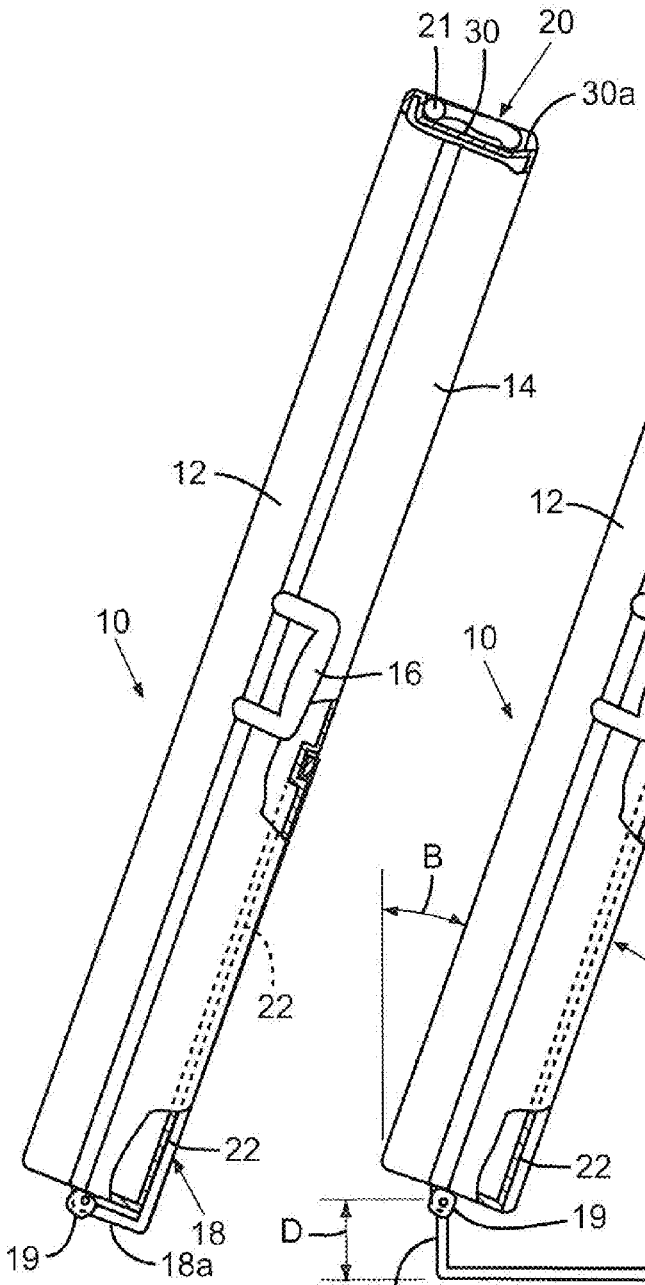
FIG. 4 is a side elevation view, with portions shown in cross section, with the stand and hanger in their fully retracted positions.
Figure 4A:
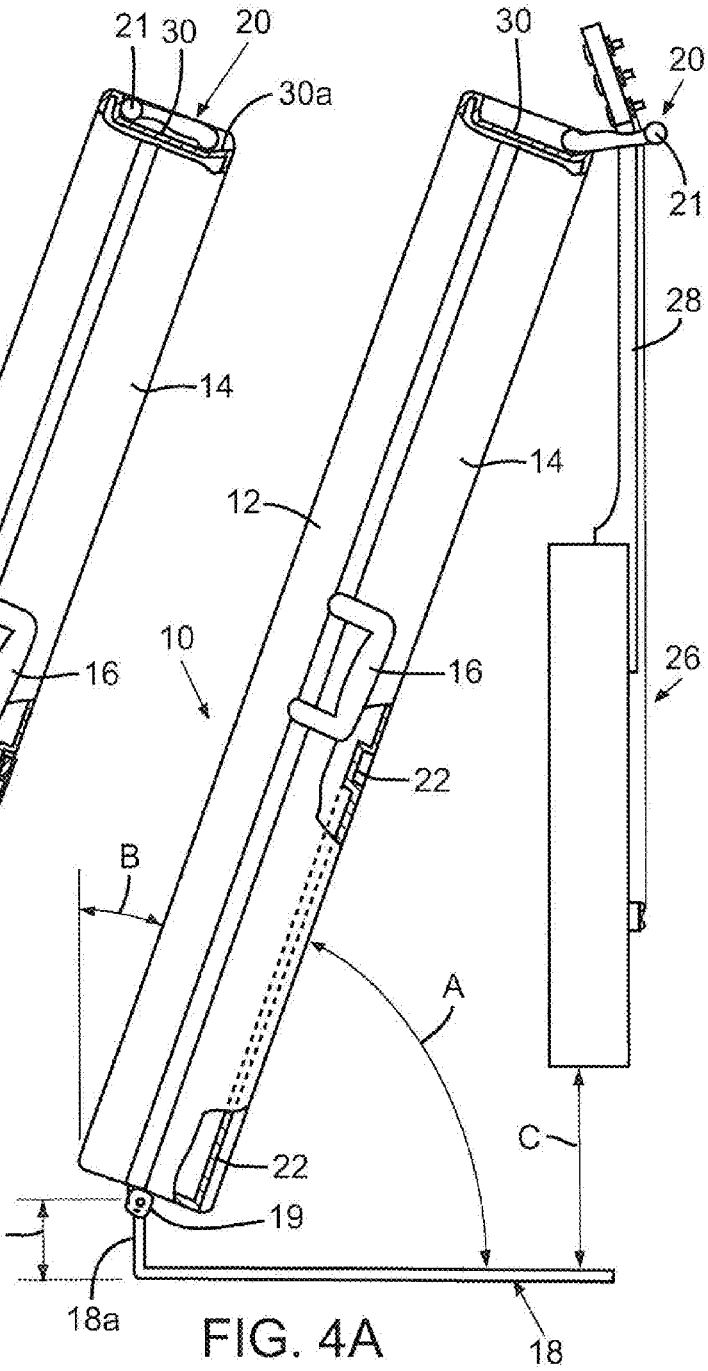
FIG. 4A is a side elevation view, with portions shown in cross section, with the stand and hanger in their fully deployed positions.

With attention now directed to FIGS. 4 and 4A, further details of stand 18, hanger 20 in their respective retracted and deployed positions will be described. As shown in FIG. 4, stand 18 is retracted within recess or groove 22, so that a portion of stand 18, indicated at 18*a*, is substantially parallel to the end of guitar case 10. The length of portion 18*a* of stand 18 will be in the range generally of about 3-6 inches, depending upon the dimensions of the musical instrument case. As shown in FIG. 4A, when stand 18 has been deployed, an overstop portion on pivot 19 orients guitar case 10 so that it is positioned at an angle A, generally in the range of 30-70 degrees relative to the horizontal, preferably about 60-65 degrees. With that orientation, the guitar case is positioned at an angle B generally in the range of 20-60 degrees, preferably about 25 degrees relative to the vertical. This inclination of guitar case 10 enables guitar 26 to be suspended, as previously described, so that the bottom of the guitar case is positioned generally in the range of 4-8 inches, as indicated at C, above the ground or the top surface of stand 18.

As also shown in FIG. 4A, when stand 18 is deployed, there is a distance indicated at D, in the range of 3-6 inches so that the bottom of the guitar case is positioned above the ground. That is important for someone who wishes to gain access to the guitar case, by opening lid 12. Specifically, as a person opens lid 12, they would approach close enough to grab handle 16 and the dimension indicated by D provides space for their feet to be positioned beneath and next to the guitar case.

As shown in FIGS. 4 and 4A, a recess 30 is provided for receiving hanger 20, and that recess includes an inclined portion 30*a* so that handle 20 can be pivoted or deployed outwardly a predetermined distance only so far, generally to permit it to be positioned horizontally relative to the floor, as shown in FIG. 4A.

The guitar case provided with the foldable or retractable stand and hanger, as described above, provide numerous advantages to musicians, which can be utilized during practices, rehearsals, and live shows, amongst other uses. For example, considering a live show, a musician during set up would position the guitar case, with stand 18 and hanger deployed, so that when lid 12 is opened the guitar may be removed and then suspended as shown in FIG. 4A. The guitar case never has to be laid on the ground or a stage. Bands often include multiple guitars, and an attractive set up or display of guitars could be provided before the start of a performance. Moreover, a guitar is readily available within reach of a musician and after a song or songs have been played, the guitar may positioned for suspension during, for example, a break by the musicians. An important feature of the guitar case/stand/hanger arrangement as above described is that lid 12 may be opened for access by the musician while a guitar is suspended. Because stand 18 is mounted on the bottom of the case, on portion 14, the lid may be opened and closed without disturbing a suspended instrument; access to the interior of the guitar case may be necessary to obtain or exchange picks, sheet music, a tuner, etc. The important point to note is that the musical instrument is displayed or suspended while free access to the interior of the guitar case is permitted.

While suspension of a guitar as described finds utility during a live show, the suspension may provide advantages for display at a non-performance venue, for example in a musical instrument store. More specifically, a guitar case may be displayed, in an upright position while a guitar itself is simultaneously displayed, as such being contained within the guitar case. Thus a guitar may be displayed upright, for close inspection by a perspective purchaser, without the guitar having to be mounted on a wall, positioned on a table or even mounted within the guitar case itself.

The provision of the stand and hanger on the lower portion of a guitar case, permits opening of the lid. Moreover, with stand 18 mounted on the bottom of the guitar case, specifically on the lower portion, as shown in FIGS. 1-3, and more specifically as shown in FIGS. 4 and 4A, the bottom of the guitar case is elevated so that a person may walk close and open the guitar case with plenty of clearance for a person's feet.

We claim:

1. A musical instrument case, comprising:

a main body, a cavity being provided therein for receiving a musical instrument having a large body and a narrow neck, said neck being coupled to an enlarged portion that is wider than the adjacent portion of said neck;

a cover, selectively movable between a position for covering said cavity in said main body and openable for enabling access to said cavity;

a stabilizing apparatus, pivotably coupled to said main body such that said stabilizing apparatus can assume a folded position in which it does not substantially extend away from said main body, and an unfolded position in which it can support said main body to stand upright;

an instrument hanger, pivotably coupled to said main body and capable of receiving said neck of said musical instrument, whereby said musical instrument can be suspended.

2. The musical instrument case of claim 1, wherein said stabilizing apparatus:

is primarily oriented in a substantially horizontal plane when in the unfolded position;

has an overall width comparable to that of said main body;

is pivotably coupled to the base of said main body; and is in the form of an elongated member or members.

3. The musical instrument case of claim 1, wherein an indentation is provided in said main body, said indentation being configured to receive said stabilizing apparatus in the folded position.

4. The musical instrument case of claim 1, wherein said stabilizing apparatus comprises a means of selectively locking said stabilizing apparatus in the unfolded position.

5. The musical instrument case of claim 1, wherein a means is provided for securing said stabilizing apparatus in the folded position.

6. The musical instrument case of claim 1, wherein a means is provided for securing said instrument hanger in the folded position.

* * * * *